US009850712B2

(12) United States Patent
Sugiura

(10) Patent No.: US 9,850,712 B2
(45) Date of Patent: Dec. 26, 2017

(54) DETERMINING DRILLING STATE FOR TRAJECTORY CONTROL

(71) Applicant: Schlumberger Technology Corporation, Sugar land, TX (US)

(72) Inventor: Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 487 days.

(21) Appl. No.: 14/534,119

(22) Filed: Nov. 5, 2014

(65) Prior Publication Data

US 2015/0167392 A1 Jun. 18, 2015

Related U.S. Application Data

(60) Provisional application No. 61/915,100, filed on Dec. 12, 2013.

(51) Int. Cl.

| | |
|---|---|
| ***G01V 9/00*** | (2006.01) |
| ***E21B 7/04*** | (2006.01) |
| ***E21B 44/00*** | (2006.01) |
| *G06F 11/30* | (2006.01) |
| *E21B 41/00* | (2006.01) |

(52) U.S. Cl.

CPC ..... *E21B 7/04* (2013.01); *E21B 44/005* (2013.01); *E21B 2041/0028* (2013.01)

(58) Field of Classification Search

CPC ..... E21B 7/04

See application file for complete search history.

(56) References Cited

U.S. PATENT DOCUMENTS

| | | | |
|---|---|---|---|
| 2,172,325 | A | 9/1939 | Victor et al. |
| 2,177,738 | A | 10/1939 | Nolan |
| 2,282,165 | A | 5/1942 | Corson |
| 5,113,953 | A | 5/1992 | Noble |
| 5,265,682 | A | 11/1993 | Russell et al. |
| 5,603,386 | A | 2/1997 | Webster |

(Continued)

FOREIGN PATENT DOCUMENTS

| | | |
|---|---|---|
| EP | 1024245 | 10/2004 |
| EP | 2669469 | 12/2013 |

OTHER PUBLICATIONS

International search report and written opinion for the equivalent PCT patent application No. PCT/US2014/066255, dated Mar. 16, 2015.

(Continued)

*Primary Examiner* — Phuong Huynh

(57) ABSTRACT

Methods are provided for determining the drilling state of a downhole tool and controlling the trajectory of the downhole tool in a wellbore during a drilling operation. One method may include identifying a drilling parameter indicative of the drilling state of the downhole tool in the wellbore. The method may also include determining the drilling state based on the identified drilling parameter. The identified drilling parameter may be obtained from a sensor communicatively coupled with a processor and disposed in the wellbore. The method may further include adjusting the operation of an integral controller based on the determined drilling state to control the trajectory of the downhole tool in the wellbore during the drilling operation.

20 Claims, 6 Drawing Sheets

(56) References Cited

U.S. PATENT DOCUMENTS

| | | | | |
|---|---|---|---|---|
| 6,092,610 | A | 7/2000 | Kosmala et al. | |
| 6,109,372 | A | 8/2000 | Dorel et al. | |
| 6,290,003 | B1 | 9/2001 | Russell | |
| 2004/0040746 | A1* | 3/2004 | Niedermayr | E21B 21/08 175/38 |
| 2006/0260843 | A1 | 11/2006 | Cobern | |
| 2007/0168056 | A1 | 7/2007 | Suayegi et al. | |
| 2013/0161097 | A1 | 6/2013 | Benson et al. | |

OTHER PUBLICATIONS

"Naive Bayes classifier" at http://en.wikipedia.org/wiki/Naive_Bayes_classifier.

* cited by examiner

DETERMINING DRILLING STATE FOR TRAJECTORY CONTROL

RELATED APPLICATIONS

This application claims the benefit of a related U.S. Provisional Application Ser. No. 61/915,100 filed Dec. 12, 2013, entitled "Determining Drilling State for Trajectory Control," to Junichi Sugiura, the disclosure of which is incorporated by reference herein in its entirety.

BACKGROUND

Embodiments described herein generally relate to trajectory control during drilling operations. More particularly, embodiments described herein relate to methods for determining drilling states of a downhole tool and controlling the trajectory thereof during the process of drilling a wellbore in a subterranean formation.

Directional drilling is the process of directing the downhole tool in a wellbore being drilled along a defined trajectory to a predetermined target. Trajectory control during drilling is the process of keeping the wellbore contained within some prescribed limits based on the measurement of the inclination and direction (azimuth) of the drill string at various formation depths utilizing various sensors. In drilling operations utilizing a rotary steerable system (RSS), a proportional controller may be used in trajectory control applications in order to implement the Inclination Hold (IH) mode and the Hold Inclination and Azimuth (HIA) mode; however, well-known dynamic conditions sometimes encountered during drilling, including, for example, axial vibration, lateral shock and vibration, torsional vibration, stick/slip, whirl, formation/bottom hole assembly tendency changes, bit walk tendencies, and dogleg output changes due to borehole overgauge, may reduce the effectiveness of the proportional controller (e.g., steady-state error). In addition, sensor response (measurement) delay and wellbore propagation delay, due to the distance between the drill bit and the sensor location, may also reduce the effectiveness of the proportional controller.

Accordingly, a proportional integral (PI) controller or any other controller with an integration term may be utilized to account for the dynamic conditions and the delays in the sensor and system responses. Although the use of the integrator in the PI controller may account for the above dynamic conditions and steady-state error, the integrator generally may not distinguish the drilling states (e.g., active drilling, circulating on bottom, back-reaming, etc.) from one another. In certain drilling states, e.g., back-reaming and circulating on bottom, the utilization of the integrator generally tends to inhibit trajectory control, thereby reducing accuracy of the wellbore trajectory during the directional drilling operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for determining a drilling state of a downhole tool during a drilling operation is disclosed. The method may include establishing a threshold value for a drilling parameter indicative of the drilling state of the downhole tool and determining an actual value of the drilling parameter via a measurement associated with the downhole tool, a wellbore in which the downhole tool is disposed, or a combination thereof. The threshold value of the drilling parameter and the actual value of the drilling parameter may be compared to determine the drilling state.

In another embodiment, another method for determining a drilling state of a downhole tool in a wellbore during a drilling operation is disclosed. The method may include transmitting a signal generated by a sensor to a processor. The signal may be indicative of a drilling parameter associated with the downhole tool, and the sensor may be located in the wellbore. The signal may be processed in a processor. The processor may be encoded to utilize statistical analysis of the drilling parameter to determine the drilling state of the downhole tool in the wellbore.

In another embodiment, a method for controlling the trajectory of a downhole tool in a wellbore during a drilling operation is disclosed. The method may include identifying a drilling parameter indicative of a drilling state of the downhole tool in the wellbore. The drilling state may be determined based on the identified drilling parameter. The identified drilling parameter may be obtained from a sensor communicatively coupled with a processor and located in the wellbore. The operation of an integral controller may be adjusted based on the determined drilling state to control the trajectory of the downhole tool in the wellbore during the drilling operation.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings are only illustrative embodiments, and are, therefore, not to be considered limiting of its scope, for the invention may admit to other equally effective embodiments.

DETAILED DESCRIPTION

Figure 1:
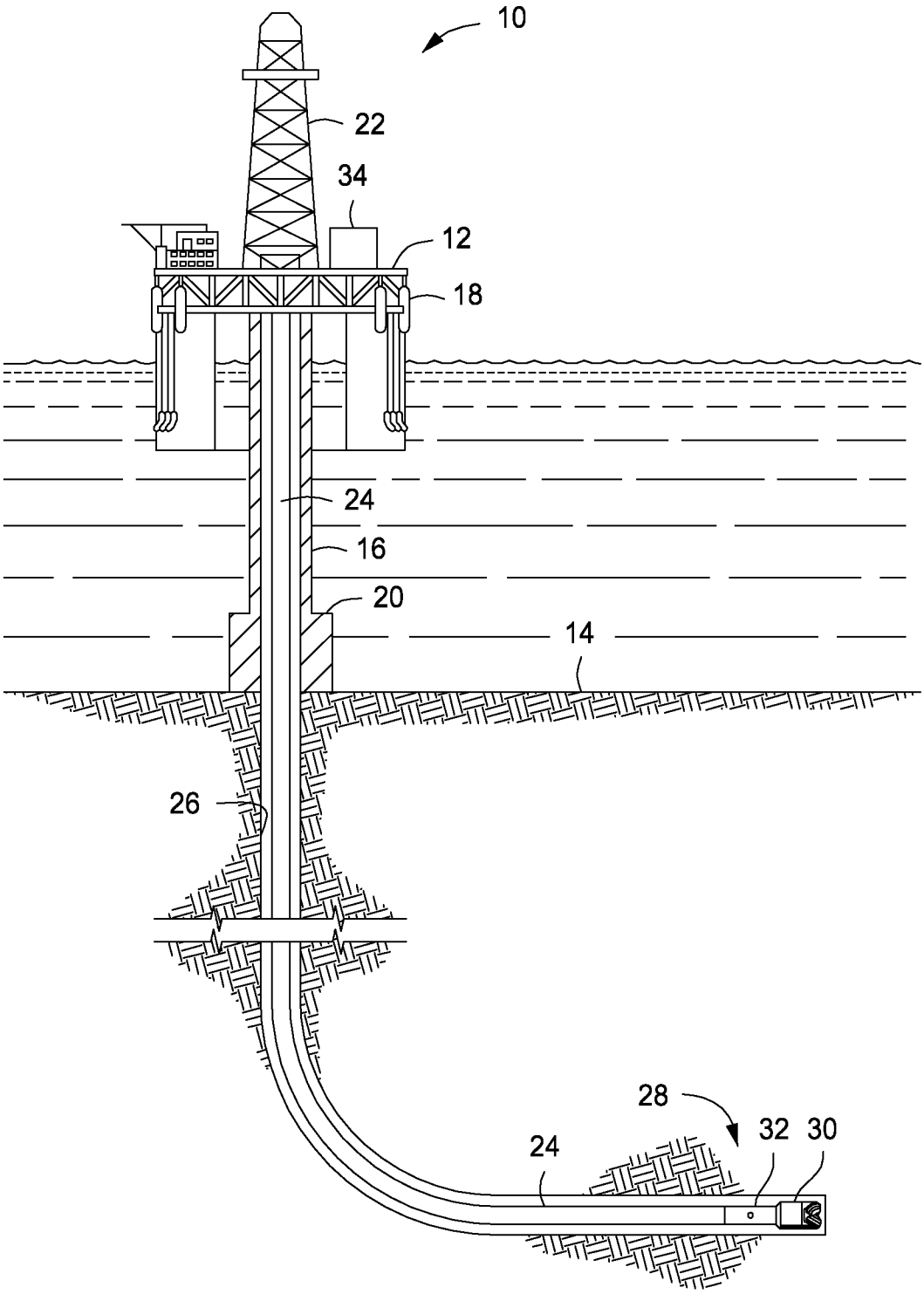
FIG. 1 illustrates an example of a drilling system on which disclosed methods may be utilized.

FIG. 1 depicts an example drilling rig 10 suitable for using various method embodiments disclosed herein. A semisubmersible drilling platform 12 may be positioned over an oil or gas formation (not shown) disposed below the sea floor 14. A subsea conduit 16 may extend from a deck 18 of the semisubmersible drilling platform 12 to a wellhead installation 20. The platform may include a derrick 22 and a hoisting apparatus for raising and lowering a drill string 24, which, as shown, extends into a wellbore 26 and is coupled to a bottom hole assembly (BHA) 28. The drill string 24 may be rotatably driven by the drilling rig 10, which may also supply a drilling fluid, under pressure, through the upper and central portions of the drill string 24 to the BHA 28 and a drill bit 30 included therein.

In order to achieve directional control while drilling, the BHA 28 may include one or more drill collars, one or more drill collar stabilizers, and a rotary steerable system (RSS) 32. The RSS 32 may be the lowest component of the BHA 28 connected to the drill bit 30 and may include a control section having, for example, one or more sensors, an electronics package including one or more controllers, communication equipment, data-processing equipment including one or more processors, and other components utilized for the control of the RSS 32. The RSS 32 may also include a steering section connected to the drill bit 30. A surface control system 34 may be utilized in part to communicate steering commands to the electronics package in the RSS control section via known methods in the art (e.g., mud-pulse telemetry). Although the RSS is described herein in terms of a two-section RSS, the RSS is not intended to be limited thereto. For example, the control section and steering section may be integrally combined in one component.

The RSS control section is, in an example embodiment, connected to the last of the drill collars or to any other suitable downhole component. Other components suited for attachment of control section, or the RSS 32 in general, include drilling motors, drill collars, logging while drilling (LWD) tools, measuring while drilling (MWD) tools, tubular segments, data communication and control tools, cross-over subs, and borehole enlargement tools. In an embodiment, stabilizers may be attached to the RSS control section and to the RSS steering section; however, it will be appreciated by those of ordinary skill in the art that other stabilizer configurations may be provided.

As noted above, the RSS control section may include one or more sensors for sensing downhole characteristics of the BHA 28, components thereof, the wellbore 26 and/or the surrounding formation. In an example embodiment, the RSS control section may include a plurality of sensors including an accelerometer sensor, such as a tri-axial accelerometer sensor, and a magnetometer sensor, a gyro sensor, and may optionally further include a logging while drilling sensor, such as a natural gamma ray sensor. In addition, the plurality of sensors may include vibration and shock sensors, a downhole fluid pressure sensor, a flow meter, a bending moment sensor, a weight-on-bit (WOB sensor), and/or a torque-on-bit (TOB) sensor. In at least one embodiment, the sensors may be deployed as close to the drill bit 30 as possible, for example, within three meters, or even within one meter, of the drill bit 30.

Suitable accelerometers for use may be chosen from among any suitable commercially available devices known in the art. For example, suitable accelerometers may include Part Number 979-0273-001 commercially available from Honeywell International Inc., and Part Number JA-5H175-1 commercially available from Japan Aviation Electronics Industry, Ltd. (JAE). Suitable accelerometers may also include micro-electro-mechanical systems (MEMS) solid-state accelerometers, available, for example, from Analog Devices, Inc. of Norwood, Mass. Such MEMS accelerometers may be suitable for certain near bit sensor sub applications since such sensors tend to be shock resistant, high-temperature rated, and inexpensive. Suitable magnetic field sensors may include conventional three-axis ring core flux gate magnetometers or conventional magnetoresistive sensors, for example, Part Number HMC-1021D, available from Honeywell International Inc.

The accelerometer and magnetometer sensors may be configured for making downhole navigational (surveying) measurements during a drilling operation. Such measurements are well known and commonly used to determine, for example, borehole inclination, borehole azimuth, gravity toolface, and magnetic toolface. Being configured for making navigational measurements, the accelerometer and magnetometer sensors may be rotationally coupled to the drill bit 30 (e.g., rotationally fixed to the RSS control section which rotates with the drill bit 30). The accelerometers may also be electronically coupled to a digital controller via a low-pass filter (including an anti-aliasing filter) arrangement. Such "DC coupling" is generally desirable for making accelerometer based surveying measurements (e.g., borehole inclination or gravity toolface measurements). The use of a low-pass filter band-limits sensor noise (including noise caused by sensor vibration) and, therefore, tends to improve sensor resolution and surveying accuracy.

The surface control system 34 and/or the RSS control section may include one or more controllers communicatively coupled to one or more of the sensors and configured to receive and transmit signals regarding trajectory control of the RSS 32. Specifically, the one or more controllers may be configured to implement the Inclination Hold (IH) mode and the Hold Inclination and Azimuth (HIA) mode. These steering modes are automated closed-loop functions that allow the RSS to automatically target and maintain operator-defined inclination and azimuth settings.

Figure 2:
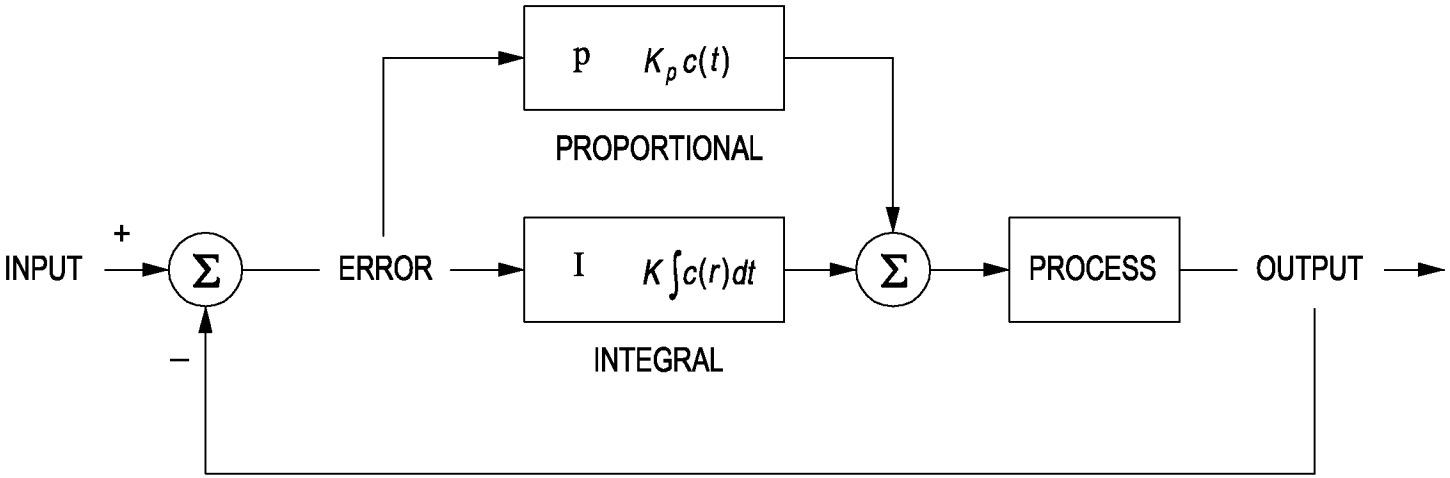
FIG. 2 illustrates a schematic view of an example control algorithm used to control actual inclination and azimuth.

The one or more controllers may include an integral controller, such as a proportional integral (PI) controller. FIG. 2 depicts an example control algorithm used to control actual inclination and azimuth utilizing a proportional integral controller. In another embodiment, the one or more controllers may include a proportional-integral-derivative (PID) controller; however, it will be appreciated that the one or more controllers may include any controller utilizing an integrator including, but not limited to, a Smith predictive controller, a dynamics matrix controller, and a generalized predictive controller. Also, in other embodiments, the one or more controllers may include other types of adaptive controllers, such as dual adaptive controllers, model identification adaptive controllers, and tracking controllers.

The integral controller may be utilized during active drilling, i.e., removing earthen material, generally rock, dirt, and other sedimentary material via the drill bit 30, to improve trajectory control of the RSS 32; however, in an example embodiment, during non-drilling (for example, during back-reaming and circulating on bottom) the utilization of the integral controller is suspended, or otherwise rendered inoperable, as the integral controller during non-drilling operations may reduce the effectiveness of the controller(s) to maintain operator-defined inclination and azimuth settings. Accordingly, the present disclosure may provide example embodiments of a method for determining the drilling state during drilling operations. Such embodiments may be utilized to improve steering or trajectory control by regulating the use of the integrative controller in the surface control system 34 and/or the RSS control section.

Although the example embodiments are described in use with the RSS 32, it will be appreciated that example embodiments may be utilized with other "intelligent" steerable systems, such as an integrated rotary-steerable motor, a coiled-tubing steerable system, and bit-based steerable systems. In addition, example embodiments may be utilized with other downhole tools, including, for example, MWD tools and LWD tools. In one or more embodiments, these downhole tools may be generally connected with one another through a common communication bus and the determined drilling state may be communicated amongst the communicatively-connected downhole tools. The common communication bus may be or include an electromagnetic (EM) shorthop, acoustic shorthop, or high-speed wired drill-pipe bus. Thus, signals generated by one or more sensors from any downhole tool communicatively-connected to the common communication bus may be processed by a processor located in the BHA 28.

Figure 3:
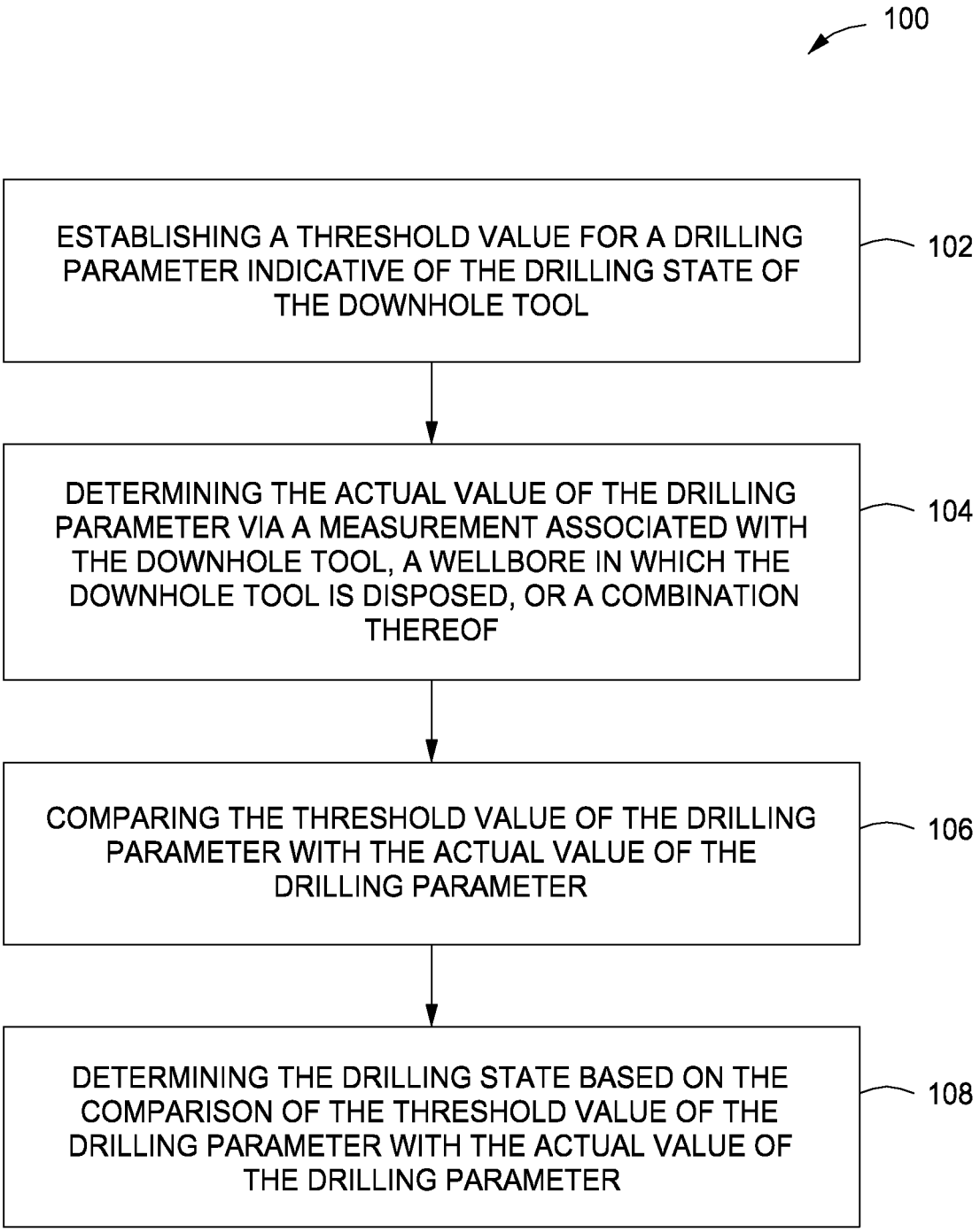
FIG. 3 illustrates a flowchart of an example method for determining a drilling state of a downhole tool during a drilling operation.

FIG. 3 depicts a flowchart of one example method 100 for determining the drilling state of a downhole tool in a wellbore during drilling operations. The downhole tool may be or include the RSS. For example, the downhole tool may include the BHA including the RSS and the drill bit. In another embodiment, the downhole tool may be or include, but is not limited to, a LWD tool or a MWD tool. In an example embodiment, the determined drilling state may be a first drilling state or a second drilling state. The first drilling state may be indicative of active drilling, in which the earthen material, generally rock, dirt, and other sedimentary material, is removed via the drill bit as the drill bit progresses generally in a downstream direction, i.e., a direction away from the surface of the formation or the surface of a body of water. The second drilling state may be indicative of non-drilling, in which the drill bit is not contacting the earthen material in a downstream direction. Examples of non-drilling may include back-reaming, circulating on bottom, and the like.

The method 100 may include establishing a threshold value for a drilling parameter indicative of the drilling state of the downhole tool, as at 102. In an example embodiment, the drilling parameter may be a flow rate of the drilling fluid, a pressure differential in the downhole tool and the annulus of the wellbore, variance in a rotary speed (e.g., fluctuations, such as stick-slip) of the downhole tool, a rotary speed of the downhole tool, vibration of the downhole tool, the torsional load, the axial load, a noisiness factor (e.g., standard deviation or difference between minimum and maximum values in a selected interval) of an accelerometer, or a noisiness factor (e.g., standard deviation or difference between minimum and maximum values in a selected interval) of an axial load.

The noisiness factor, or "noisiness," of the accelerometer may be used for drilling state classification. The noisiness may be calculated in various manners, such as standard deviation or the difference between minimum and maximum values in a selected interval. In an example embodiment, the difference between the minimum and maximum accelerometer values is evaluated at 10 ms intervals over a 1-second period as shown in the following equation:

$$Gz_diff_1sec = Gz_max_1sec - Gz_min_1sec$$

Gz_diff_1sec is the difference between the maximum and minimum values over a 1-second period and may be expressed in mG. Gz_diff_1sec is available each second. In the above equation, the raw accelerometer data may be utilized for this computation. The foregoing may effectively approximate a standard deviation of the accelerometer signal, assuming the accelerometer signal has a normal Gaussian distribution. The estimate (approximate) of the standard deviation may be expressed:

$$Gz_std_app = Gz_diff_1sec/4$$

Although this estimate may not be as reliable as an estimate based on calculations over a large number of samples, it may be useful as a preliminary estimate. Often, the estimate may be calculated by dividing by 4 instead of 6, especially if good information is unknown about the largest and smallest possible observations. The standard deviation of the accelerometer reading may also be computed each second using the following equation:

$$\text{Gz_std_exact} = sqrt(E[Gz^2] - E[Gz]^2) = \sqrt{\frac{\sum_{n=1}^{N} Gzn^2}{N} - \left(\frac{\sum_{n=1}^{N} Gzn}{N}\right)^2}$$

where E[ ] denotes an expected value and Gzn is the nth data point, and N is the total number of samples per second.

In another embodiment, the method 100 may include establishing a plurality of threshold values for a respective plurality of drilling parameters, such that more than one drilling parameter may be utilized to determine the drilling state of the downhole tool. For example, threshold values for the rotary speed of the drill bit and the flow rate of the drilling fluid may be utilized concurrently to determine the drilling state. The threshold value may be established manually or may be established automatically. In one or more embodiments, the threshold value may be stored in a memory component operatively coupled to a processor.

In an example embodiment, the threshold value may be established manually. An operator of the drilling rig during drilling operations may select a threshold value indicative of a drilling state based on a number of factors, including but not limited to, surface parameters, wellbore conditions, predetermined procedures, and/or previous experiences. For example, the operator may select a threshold value of 60 revolutions per minute (RPM) for the drill bit of the RSS. In a motor-assist configuration of the RSS, the threshold value may be chosen to be higher, for example, 100 RPM. The threshold value may change due to changes in the wellbore profile or formation, which may relate to the speed that the operator has selected to drill the well at that particular depth and/or formation. For example, by establishing a threshold value of 60 RPM for the rotary speed of the drill bit, avoidance of the misclassification of the drilling state may be accomplished in case of rig equipment failure and repair. In such cases, a surface operator might have to circulate the drilling fluid and rotate the drill string. In such a case, to avoid misclassification of the downhole drilling state, the operator may be able to rotate the drill string below the threshold value (e.g., 30 RPM).

Figure 4:
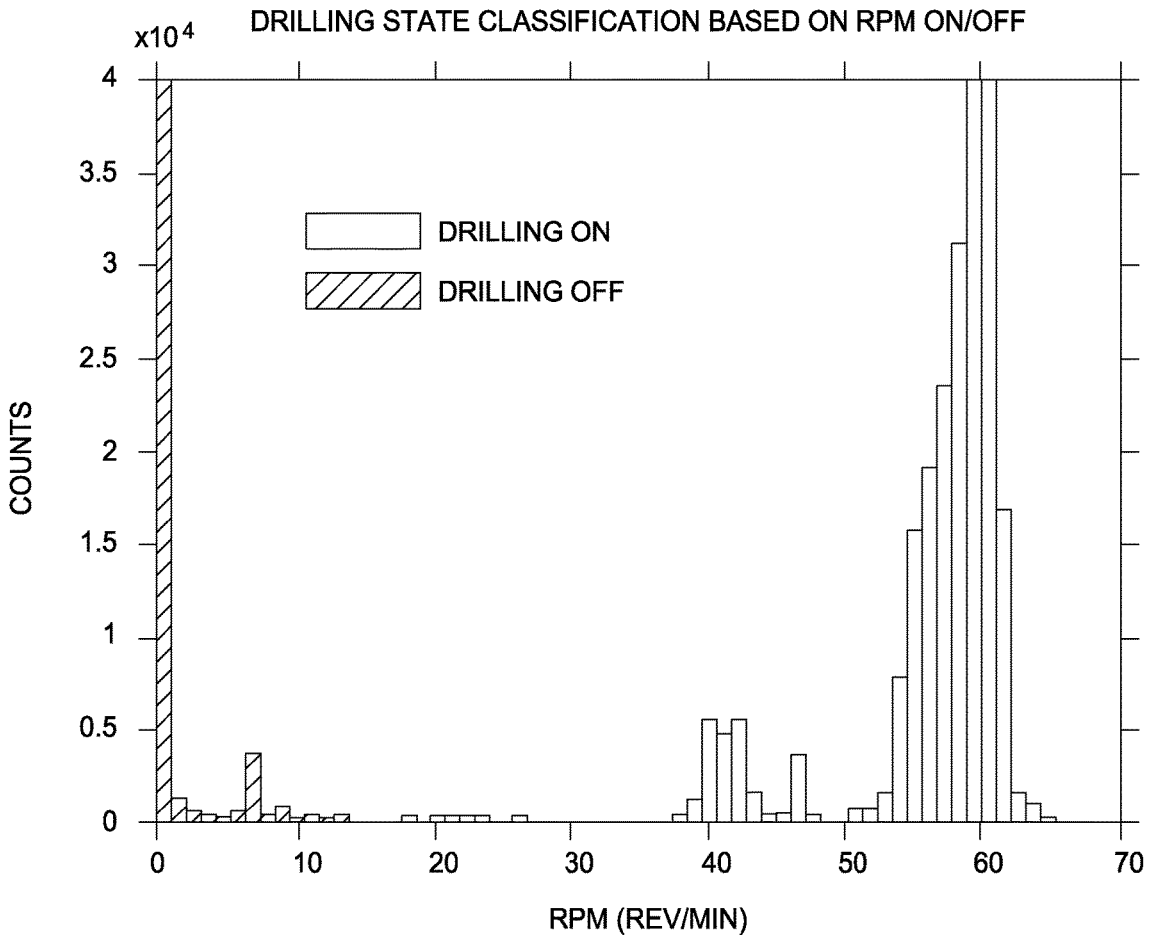
FIG. 4 illustrates a graph of rotational speed (revolutions per minute) of a drill bit of a downhole tool during a selected interval, according to an example embodiment.

In another embodiment, the threshold value may be established automatically utilizing statistical analysis to determine the optimal threshold value of the drilling parameter. For example, a histogram may be established from empirical data for the drilling parameter. FIG. 4 is a graph illustrating the empirical data plotted for the rotary speed of the drill bit in the downhole tool based on the surface parameters. The empirical data may be obtained from sampling a drilling operation for a selected interval, knowing the ground truth about the drilling state at the surface. From the plot, it may be determined that optimal threshold values may be associated with corresponding surface-observed drilling states. As shown in FIG. 4, a rotary speed of 60 RPM may be chosen as the optimal threshold value for the determination of the drilling state. In another embodiment, the standard deviation of an accelerometer or a standard deviation of an axial load may be utilized as the threshold value of the drilling parameter. The hysteresis may be applied to each threshold.

The method 100 may include determining the actual value of the drilling parameter via a measurement associated with the downhole tool, a wellbore in which the downhole tool is disposed, or a combination thereof, as at 104. The actual value of the drilling parameter may be provided by one or more sensors communicatively coupled with the downhole tool, surface controls, and/or the wellbore. For example, a sensor located on the downhole tool may transmit a signal indicative of the rotary speed of the drill bit to the surface controls. The actual value of the drilling parameter may be compared to the threshold value of the drilling parameter, as at 106. A rule-based algorithm may be utilized to determine the drilling state, as at 108, based on the comparison at 106 of the drilling parameter and the actual value of the drilling parameter. As such rule-based algorithms generally involve utilization of little computational load, these rule-based algorithms may be suitable for use in downhole processors.

The rule-based algorithm may be executed by a processor or may be conducted by the operator on-site or off-site. For example, the actual value may be transmitted to the processor operatively coupled with the memory component storing the threshold value. The processor may be encoded with the rule-based algorithm. The processor may compare the actual value to the threshold value, and based on the rule-based algorithm, determine the drilling state of the downhole tool in the wellbore. For example, the rule-based algorithm may provide that if the rotary speed is equal to or greater than 60 RPM, then the drilling state is active drilling; conversely, the rule-based algorithm may provide that if the rotary speed is less than 60 RPM, then the drilling state is non-drilling. In another embodiment, the operator may view the actual value provided by the one or more sensors on a graphical user interface, e.g., monitor, at the surface control system 34 and determine the drilling state based on the comparison of the actual value and threshold value.

Figure 5:
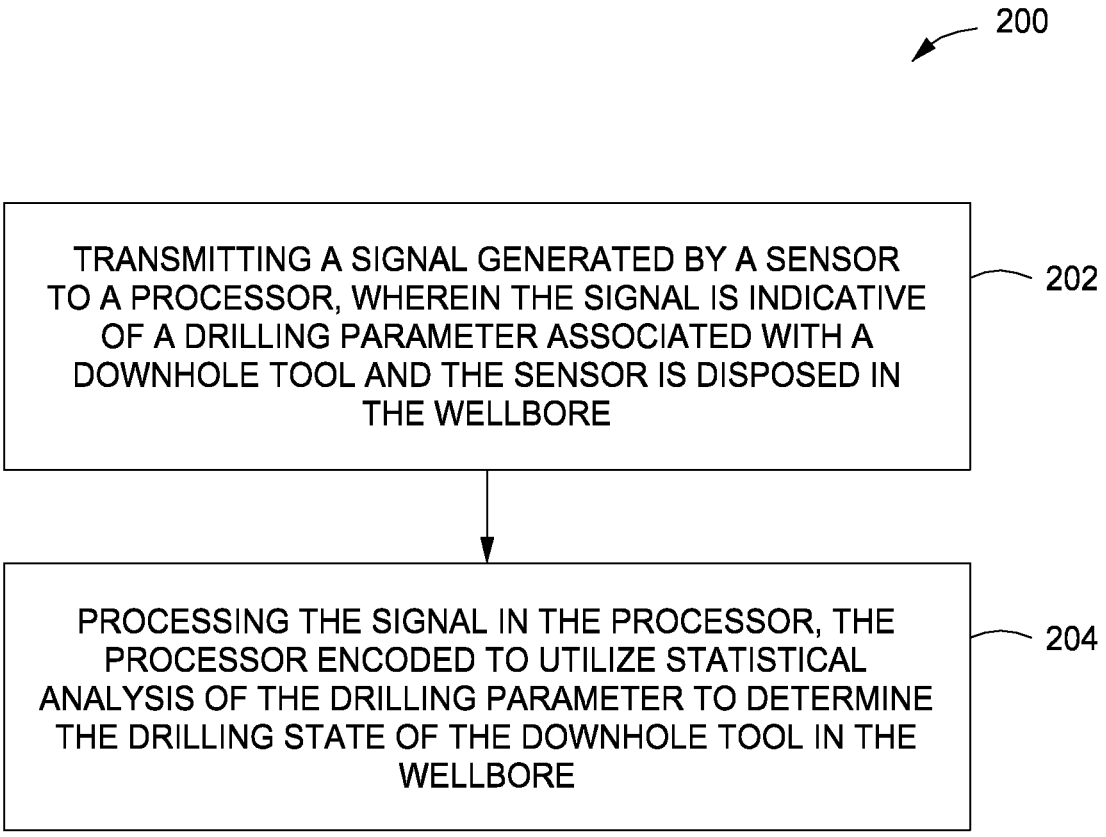
FIG. 5 illustrates a flowchart of an example method for determining a drilling state of a downhole tool in a wellbore during a drilling operation.

FIG. 5 depicts a flow chart of another example of a method 200 for determining the drilling state of a downhole tool in a wellbore during drilling operations. In the method 200, statistical analysis may be utilized to determine the drilling state of the downhole tool in the wellbore. The empirical data for the statistical analysis may be provided, for example, by sampling a drilling operation for a selected interval as shown in FIG. 4. In an example embodiment, a processor may be encoded with a Bayesian classification and may be referred to as a Bayesian classifier. The empirical data, or training data, is provided to determine the basic statistical parameters, such as, for example, the mean values vector and covariance matrix. This process is generally referred to as supervised learning in the field of machine learning and data mining.

The Bayesian classifier includes a fixed number of the features (for example, bit rotary speed, flow rate, downhole weight on bit, axial accelerometer "noisiness," and bit pressure drop). The classified patterns x are described by n-features $x=[x1, x2 \ldots xn]^T$ and by pattern space which contains R disjunctive subsets or, r=1, 2 . . . R. The Bayes classifier uses criterion of the minimum error:

$$J = \sum_{r=1}^{R} \int_{Q_r} \sum_{s=1}^{R} \lambda(d_B(x) \mid \omega_s) p(x \mid \omega_s) P(\omega_s)\, dx$$

where $\lambda\,(d_B(x)|\omega S)$ is the loss function and $d_B(x)$ is an optimal Bayes decision rule which minimizes average loss in the above equation. The valuation of criterion in this form is difficult; therefore, it may be transformed to simpler form:

$$L_x(\omega_r) = \sum_{s=1}^{R} \lambda(\omega_r \mid \omega_s) p(x \mid \omega_s) P(\omega_s).$$

The above equation represents the loss that will occur after the classification of pattern x into the class $\omega_r$, if the pattern does not belong to this class. If the patterns x from miscellaneous classes are like the statistical set, these patterns can be approximated by normal distribution. The conditional probability density function in R dimensions is written as:

$$p(x \mid \omega) = \frac{1}{2\pi^{R/2}\sqrt{|W|}} \exp\left(-\frac{1}{2}(x-\mu)^T W^{-1}(x-\mu)\right)$$

where |W| is determinant of covariance matrix. The covariance matrix W is $$W = \frac{1}{K}\sum_{i=1}^{K}\left[(x^i-\mu)(x^i-\mu)^T\right]$$

where K is number of patterns in the class and μ is the mean vector $$\mu = \frac{1}{K}\sum_{i=1}^{K} x^i$$

An augmented classifier tests Mahalanobis distance $D_M$ by chi-quadrate distribution $\chi_\alpha^2(n)$ with the number of features n and with the significance level α. The Mahalanobis distance becomes for class $\omega_r$, where r=1, 2 . . . R:

$$D_M r^2 = (x-\mu_r)^T W^{-1}(x-\mu_r)$$

On the basis of this test, the result of classification is:

If $D_M r^2 \le \chi_\alpha^2(n)$, then x belongs to class $\omega_r$.

If $D_M r^2 > \chi_\alpha^2(n)$, then x belongs to class $T_0$, where $T_0$ is the "other" class.

Although the Mahalanobis distance is utilized above, other classifiers and distances may be used, including, but not limited to, a Manhattan distance, a Bhattacharyya distance, and a Euclidean distance. For drilling state classification, the training data, mean and covariance matricides, and/or a particular classifier may be stored in a memory component associated with a processor.

Accordingly, each class above may be representative of respective drilling states. The drilling states may indicate either active drilling or non-drilling. The input for the Bayes classifier may be a signal generated by a sensor. Accordingly, the method 200 may include transmitting a signal generated by a sensor to the processor, the signal being indicative of a drilling parameter associated with the downhole tool, as at 202. The sensor may be disposed in the wellbore and may be an accelerometer, a vibration sensor, a flow-rate sensor, a pressure sensor, a bending moment sensor, a near-bit weight on bit sensor, a near-bit torque sensor, or a magnetometer. The method may also include processing the signal in the processor, the processor encoded to utilize statistical analysis of the drilling parameter to determine the drilling state of the downhole tool in the wellbore, as at 204. As noted above, the processor may be encoded with a Bayesian classification; however, in other embodiments, the processor may be encoded with fuzzy logic to determine the drilling state of the downhole tool in the wellbore.

In fuzzy logic operation, the input to the fuzzy system is the output of the process, which is entered into the system via input interfaces. Fuzzy processing involves the execution of IF . . . THEN rules, which are based on the input conditions. An input's grade specifies how well it fits into a particular graphic set (e.g., too little, normal, too much). The three main actions performed by a fuzzy logic controller are fuzzification, fuzzy processing, and defuzzification. When the fuzzy controller receives the input data, it translates it into a fuzzy form. This process is called fuzzification. The controller then performs fuzzy processing, which involves the evaluation of the input information according to IF . . . THEN rules created by the user during the fuzzy control system's programming and design stages. Once the fuzzy controller finishes the rule-processing stage and arrives at an outcome conclusion, it begins the defuzzification process. The fuzzy controller converts the output conclusions into "real" output data (e.g., analog counts) and sends this data to the process via an output module interface.

The fuzzification process is the interpretation of input data by the fuzzy controller. Fuzzification includes two main components: membership functions and labels. During fuzzification, a fuzzy logic controller receives input data, also known as the fuzzy variable, and analyzes it according to user-defined charts called membership functions. Membership functions group input data into sets, such as rotary speeds, that are acceptable. The controller assigns the input data a grade from 0 to 1 based on how well it fits into each membership function. The membership functions may have many shapes.

The final output value from the fuzzy controller depends on the defuzzification process used to compute the outcome values corresponding to each label. The defuzzification process examines the rule outcomes after they have been logically added and then computes a value that will be the final output of the fuzzy controller. The processor then sends this value to the output module. Thus, during defuzzification, the controller converts the fuzzy output into a real-life data value.

Figure 6:
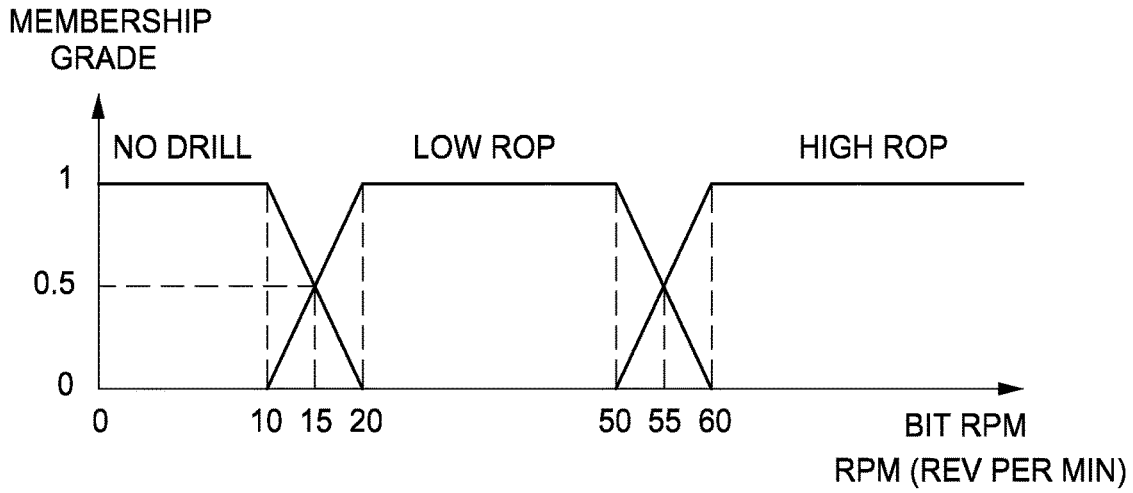
FIG. 6 illustrates a graph based on fuzzy logic of a plurality of membership functions of rotational speed (revolutions per minute) of a drill bit of a downhole tool during a selected interval, according to an example embodiment.

In an example embodiment, the drilling state may be determined utilizing fuzzy logic. Accordingly, there may be three membership function groups: (1) No Drilling, (2) Low rate of penetration (ROP) Drilling, and (3) high ROP Drilling. A bit rotation speed (RPM) may be used as a crisp input, and a state probability may be used as a crisp output. There may also be three RPM ranges. Each may be associated with a respective member function group. The first RPM range (0 RPM-20 RPM) may be associated with the member function group, No Drilling. The second RPM range (10 RPM-60 RPM) may be associated with the member function group, Low ROP Drilling. The third ROM range (50 RPM-300+ RPM) may be associated with the member function group, high ROP Drilling. These three RPM ranges may be combined by fuzzy logic. FIG. 6 shows the membership functions. The membership functions may be derived from the field data analysis or from the precise dynamic model of the drilling system. As shown, a trapezoidal member function is used; however, other member function shapes, such as, triangular, Gaussian, Poisson, and parabolic, may also be used. For example, if the field data has a Gaussian-like distribution, then the Gaussian-shaped member function may be utilized.

In order to apply the fuzzy logic to the drilling state classification process, the membership grade is interpreted as a probability for each state. Accordingly, as shown in FIG. 6, if the Bit RPM is 12.5 RPM, then the probability for non-drilling state is 0.75, the probability for low ROP is 0.25, and the probability for high ROP is 0. Thus, the Crisp OUTPUT=non-drilling state (choose the state with a highest probability). Further, as shown in FIG. 6, if the Bit RPM is 30.0 RPM, then the probability for non-drilling state is 0, the probability for low ROP is 1, and the probability for high ROP is 0. Thus, the Crisp OUTPUT=low-ROP-drilling state (choose the state with a highest probability). Further yet, as shown in FIG. 6, if the Bit RPM is 57.5 RPM, then the probability for non-drilling state is 0, the probability for low ROP is 0.25, and the probability for high ROP is 0.75. Thus, the Crisp OUTPUT=high-ROP-drilling state (choose the state with a highest probability). It will be appreciated that a proper logic may be implemented if the probability of each state is identical, such as, for example, choosing the previous state and choosing non-drilling state as a default value.

If a plurality of parameters (e.g., RPM, flow rate, and axial load) is used for the classification, each parameter goes through the fuzzy logic with its unique member function. The plurality of the output state probability may be combined using a simple probability multiplication and optionally with a weighting function for each parameter probability; however, embodiments including other known methods to combine the probabilities are contemplated herein. As such an algorithm involves little computational complexity, utilization of such may be suitable for downhole use.

In another embodiment, the method 200 may utilize a plurality of processors, such that artificial neural networking (ANN) may be utilized to determine the drilling state of the downhole tool in the wellbore. The plurality of processors may be operatively coupled to form neural networks to determine the drilling state of the downhole tool in the wellbore.

Figure 7:
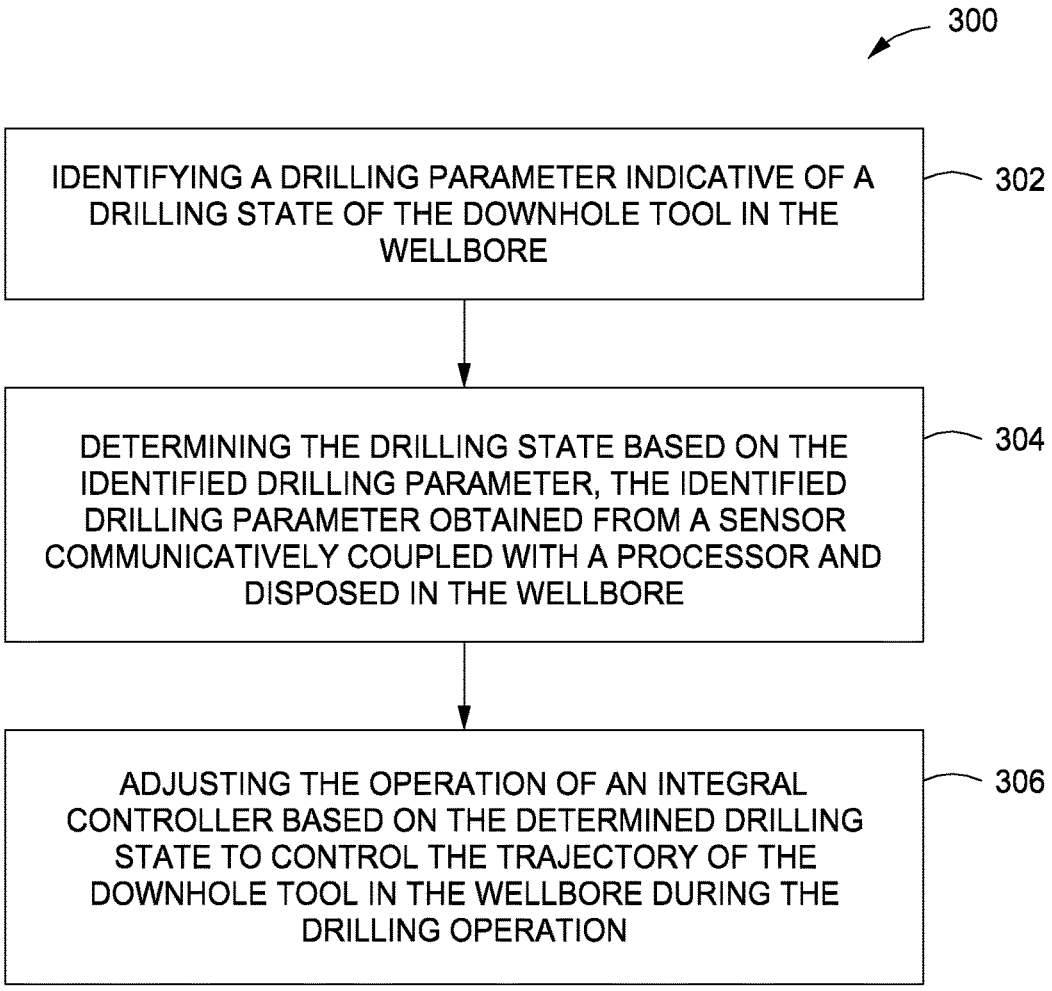
FIG. 7 illustrates a flowchart of an example method for controlling the trajectory of a downhole tool in a wellbore during a drilling operation.

FIG. 7 depicts a flow chart of an example method 300 for controlling the trajectory of a downhole tool in a wellbore during a drilling operation. The method 300 may include identifying a drilling parameter indicative of a drilling state of the downhole tool in the wellbore, as at 302. In at least one embodiment, the drilling parameter may include a flow rate of the drilling fluid, a pressure differential in the downhole tool and the annulus of the wellbore, an annular pressure in the wellbore, an internal pressure of the downhole tool, a downhole weight on bit, a downhole torque on bit, variance in a rotary speed of the downhole tool, a rotary speed of the downhole tool, vibration of the downhole tool, a noisiness factor (e.g., standard deviation) of an accelerometer, an axial load, a noisiness factor (e.g., standard deviation) of downhole torque, or a noisiness factor (e.g., standard deviation) of an axial load.

The method 300 may also include determining the drilling state based on the identified drilling parameter, the identified drilling parameter obtained from a sensor communicatively coupled with a processor and disposed in the wellbore, as at 304. Determination of the drilling state may be provided by comparing a threshold value of the drilling parameter with an actual value of the drilling parameter according to any of the methods disclosed herein. In some embodiments, the determination of the drilling state further includes evaluating the most probable downhole state based on Bayesian and/or fuzzy classification. The method may also include adjusting the operation of an integral controller based on the determined drilling state to control the trajectory of the downhole tool in the wellbore during the drilling operation, as at 306. In addition to controlling the trajectory, other activities, such as memory logging features and calibration of various downhole sensors based on the determined drilling state may also be controlled.

The adjustment of the integral controller may be based on the drilling state of the downhole tool. As noted above, the drilling state may be a first drilling state or a second drilling state. The first drilling state may be indicative of active drilling, in which the earthen material, generally rock, dirt, and other sedimentary material, is removed via the drill bit. The second drilling state may be indicative of non-drilling, in which the drill bit is not contacting the earthen material in a downstream direction, i.e., a direction away from the surface of the formation or the surface of a body of water. Examples of non-drilling may include back-reaming, forward-reaming, circulating on bottom, and the like.

In an example embodiment, the integral controller may be adjusted by closing, suspending, or otherwise rendering inoperable, the inclination controller, which provides the inclination hold mode for the downhole tool. By doing so, the integration (accumulation) of the angle error of the inclination hold mode is suspended. The integral controller may be closed, suspended, or deactivated upon determining that the drilling state is non-drilling, such as when back-reaming or circulating on bottom is occurring. Removing the error integration/corrective action during non-drilling may provide improved trajectory control of the downhole tool.

Conversely, the integral controller may be adjusted by opening, activating, or otherwise rendering operable, the inclination controller, which provides the inclination hold mode for the downhole tool. By doing so, the integration (accumulation) of the angle error of the inclination hold mode is activated. The integral controller may be opened upon determining that the drilling state is active drilling, such as when the drill bit is contacting the earthen material in a downstream direction. Activating the error accumulation and/or corrective action during active drilling may provide improved trajectory control of the downhole tool.

The integral controller may be part of a proportional integral (PI) controller. In other embodiments, the integral controller may be part of a proportional-integral-derivative (PID) controller, a Smith predictive controller, a dynamics matrix controller, or a generalized predictive controller. Further, the adjustment of the integral controller may be provided in types of adaptive controllers, such as, for example, dual adaptive controllers, model identification adaptive controllers, and tracking controllers.

In an example embodiment, the adjustment of the integral controller may be provided in a method for closed-loop toolface control (and/or dogleg severity). In closed-loop toolface control, a demand toolface and a steering ratio may be adjusted based on the history of actual toolface and steering ratio and/or back-calculated effective toolface and dogleg. The history of actual toolface may be computed each minute by accumulating the toolface differences plus the original toolface position and by summing the x- and y-components of the toolface values. The demand toolface may be adjusted based on the average historical toolface over the last minute. An example embodiment of the iteration cycle of the toolface feedback is provided as follows:

ActualTFN: Actual gravity (magnetic) toolface at N second

DeltaATFN: Delta actual gravity (magnetic) toolface between 2 consecutive values MeanDeltaATF: Average actual toolface difference MeanActualTF: Average Actual toolface over 1 minute or over 1 foot DemandTF: Demand toolface DemandTFcorr: Corrected demand toolface including toolface feedback TFcorrGain: Toolface correction gain ActualTF1, ActualTF2, ActualTF3 . . . ActualTFN DeltaATF1=ActualTF2−ActualTF1

DeltaATF2=ActualTF3−ActualTF2

. . .

DeltaATFN-1=ActualTFN−ActualTFN−1

MeanDeltaATF=(DeltaATF1+DeltaATF2+ . . . DeltaATFN−1)/(N−1)

MeanActualTF=ActualTF1+MeanDeltaATF

DemandTFcorr=(DemandTF−MeanActualTF)×TFcorrGain

In an example embodiment, the drilling state information for the downhole tool is determined in order for the toolface-feedback to function properly. By determining the drilling state information, a decision may be made whether to include the MeanDeltaATF in the above iteration. For example, if the drilling state is determined to be non-drilling (e.g., back-reaming), the MeanDeltaATF should not be computed, so as to increase accuracy in the trajectory control. Thus, the determination of the drilling state to be non-drilling would result in the removal of the MeanDeltaATF computation in the iteration. Alternatively, the survey back-calculated toolface (resultant toolface) may be used instead of the actual toolface (used in an RSS control module).

In another embodiment, the determination of the drilling state according to one or more of the example methods disclosed herein may be utilized to control the memory logging feature of LWD tools. The LWD tools, particularly imaging tools, may have limited memory space. Accordingly, by determining if the LWD tool is in an active drilling state or a non-drilling state, the LWD tools may save memory space by suspending logging of the wellbore and surrounding formation when the downhole tool is in a non-drilling state. Logging may be resumed when a determination has been made that the LWD is in an active drilling state.

In another embodiment, the determination of the drilling state according to one or more of the example methods disclosed herein may be implemented in the DMM (Drilling Mechanics Module) tool, as well as in MWD, LWD, RSS, and other downhole tools as disclosed above. It is contemplated herein that the above provided algorithms may be implemented to recognize states, such as, for example, off-bottom, back-reaming, on-bottom low ROP, on-bottom medium ROP, on-bottom high ROP, and the like. It should be appreciated that the ROP drilling states may not be limited to low, medium, and high, and that multiple range values may be utilized to classify the ROP.

As disclosed above, in one or more embodiments, any downhole tools including the provided algorithms may broadcast the drilling state to other downhole tools via a common communication bus. The common communication bus may be or include an electromagnetic (EM) shorthop, acoustic shorthop, or high-speed wired drill-pipe bus. Additionally, the drilling parameters may come from sensors associated with various different downhole tools via the common communication bus and processed by a single processor or processed by several processors on the common communication bus (distributed computing).

In another embodiment, the determination of the drilling state according to one or more of the example methods disclosed herein may be utilized for dogleg severity (DLS) control and corrections (e.g., build rate and/or turn rate control and corrections). The DLS corrections may be similar to the toolface compensation/correction algorithms provided above.

In another embodiment, the determined drilling state may be utilized to adjust the proportional controller (e.g., the gain). A common challenge in the automated steering of a downhole steerable device (e.g., RSS) is that a downhole processor associated therewith generally is not provided with the drilling speed. As a result, the proportional controller (e.g., the gain) is not properly adjusted. In an example embodiment, the determined drilling state related to the current drilling speed (e.g., ROP) may be provided to or calculated in the downhole processor to allow for the adjustment of the gain of the proportional controller used for the Inclination and/or Azimuth Hold algorithm. For example, the proportional gain of the P, PI, or PID controller may be reduced at the on-bottom high ROP drilling state from the nominal, medium-ROP gain. Conversely, the proportional gain of the P, PI, or PID controller may be increased at the on-bottom high ROP drilling state from the nominal, medium-ROP gain. It will be appreciated that the integral gain and/or derivative gain may be adjusted in the same manner as the proportional gain based on the determined drilling state related to the ROP range. Adjusting various controller gains during active drilling based on the classified ROP range may provide improved trajectory control of the downhole tool.

It will be understood that the aspects and features of the present disclosure may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The present disclosure is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. One example of high-speed downhole telemetry systems is a wired drill string, which allows high-speed two-way communications. Electronic information such as logic, software, or measured or processed data may be stored in memory (volatile or non-volatile), or on conventional electronic data storage devices well known in the art.

Although only a few example embodiments have been described in detail above, those skilled in the art will readily appreciate that many modifications are possible in the example embodiments without materially departing from "Determining Drilling State for Trajectory Control." Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for determining a drilling state of a downhole tool during a drilling operation, comprising:

deploying a bottom hole assembly in a wellbore, the downhole tool located in the bottom hole assembly and including a downhole sensor;

establishing a threshold value for a drilling parameter indicative of the drilling state of the downhole tool;

measuring an actual value of the drilling parameter using the downhole sensor the downhole tool; and causing a downhole processor located in the bottom hole assembly to compare the threshold value of the drilling parameter with the actual value of the drilling parameter and determine the drilling state based on the comparison of the threshold value of the drilling parameter with the actual value of the drilling parameter.

2. The method of claim 1, wherein the drilling parameter is selected from the group consisting of a flow rate of a drilling fluid, a pressure differential in the downhole tool and an annulus of the wellbore in which the downhole tool is disposed, an annular pressure in the wellbore, an internal pressure of the downhole tool, a downhole weight on bit, a downhole torque on bit, vibration of the downhole tool, variance in a rotary speed of the downhole tool, and a rotary speed of the downhole tool.

3. The method of claim 1, wherein establishing the threshold value for the drilling parameter indicative of the drilling state of the downhole tool comprises utilizing statistical analysis of the drilling parameter to establish the threshold value.

4. The method of claim 3, wherein a noisiness factor of the drilling parameter is the threshold value.

5. The method of claim 1, wherein the downhole tool is a rotary steerable system.

6. The method of claim 5, wherein the downhole sensor is selected from the group consisting of an accelerometer, a magnetometer, a vibration sensor, a flow-rate sensor, a pressure sensor, a bending moment sensor, a near-bit weight on bit sensor, a near-bit torque sensor, a natural gamma ray sensor, a gyro sensor, and combinations thereof.

7. The method of claim 1, wherein the drilling state is an active drilling state or a non-drilling state, the active drilling state indicative of a drill bit of the downhole tool operating to remove earthen material from the wellbore.

8. A method for determining a drilling state of a downhole tool in a wellbore during a drilling operation, comprising:

deploying a bottom hole assembly in the wellbore, the downhole tool located in the bottom hole assembly and including a downhole sensor;

transmitting a signal generated by the downhole sensor to a downhole processor located in the bottom hole assembly, wherein the signal is indicative of a drilling parameter associated with the downhole tool; and processing the signal in the downhole processor, the downhole processor encoded to utilize statistical analysis of the drilling parameter to determine the drilling state of the downhole tool in the wellbore.

9. The method of claim 8, wherein the downhole processor is encoded with a Bayesian classification.

10. The method of claim 9, wherein the downhole sensor is selected from the group consisting of an accelerometer, a vibration sensor, a flow-rate sensor, a pressure sensor, a bending moment sensor, a near-bit weight on bit sensor, a near-bit torque sensor, a natural gamma ray sensor, a magnetometer, and combinations thereof.

11. The method of claim 8, wherein the downhole processor is encoded with fuzzy logic.

12. The method of claim 8, wherein the downhole processor is communicatively coupled with at least one other processor in a neural network.

13. A method for controlling the trajectory of a downhole tool in a wellbore during a drilling operation, comprising:

deploying a bottom hole assembly in the wellbore, the downhole tool located in the bottom hole assembly and including a downhole sensor;

identifying a drilling parameter indicative of a drilling state of the downhole tool in the wellbore;

causing the downhole sensor to measure the drilling parameter;

causing a downhole processor to determine the drilling state based on the measured drilling parameter; and adjusting the operation of an integral controller located in the downhole tool based on the determined drilling state to control the trajectory of the downhole tool in the wellbore during the drilling operation.

14. The method of claim 13, wherein the downhole processor determines the drilling state based on a comparison of a threshold value of the drilling parameter with a measured value of the drilling parameter.

15. The method of claim 14, wherein the drilling parameter is selected from the group consisting of a flow rate of a drilling fluid, a pressure differential in the downhole tool and an annulus of the wellbore, an annular pressure in the wellbore, an internal pressure of the downhole tool, a downhole weight on bit, a downhole torque on bit, vibration of the downhole tool, variance in a rotary speed of the downhole tool, and a rotary speed of the downhole tool.

16. The method of claim 15, wherein establishing the threshold value for the drilling parameter indicative of the drilling state of the downhole tool comprises utilizing statistical analysis of the drilling parameter to establish the threshold value.

17. The method of claim 13, further comprising:

transmitting a signal generated by the downhole sensor to the downhole processor, the signal indicative of the drilling parameter associated with the downhole tool; and processing the signal in the downhole processor, the downhole processor encoded to utilize statistical analysis of the drilling parameter to determine the drilling state of the downhole tool in the wellbore.

18. The method of claim 17, wherein:

the downhole processor is encoded with a Bayesian classification;

transmitting the signal generated by the downhole sensor to the downhole processor comprises transmitting the signal from the downhole sensor to the downhole processor via a wired drill string; and the downhole sensor is selected from the group consisting of an accelerometer, a vibration sensor, a flow-rate sensor, a pressure sensor, a bending moment sensor, a near-bit weight on bit sensor, a near-bit torque sensor, a gyro sensor, and a magnetometer.

19. The method of claim 13, wherein:

the drilling state is a first drilling state or a second drilling state, the first drilling state indicative of active drilling in the wellbore and the second drilling state indicative of non-drilling in the wellbore; and adjusting the operation of the integral controller based on the determined drilling state comprises:

suspending the operation of the integral controller during the second drilling state; and commencing the operation of the integral controller during the first drilling state.

20. The method of claim 19, further comprising:

suspending the operation of the integral controller; and adjusting a demand toolface based on an actual toolface value, thereby controlling the trajectory of the downhole tool in the wellbore during the drilling operation.

* * * * *